US007186289B2

(12) United States Patent
Kato et al.

(10) Patent No.: US 7,186,289 B2
(45) Date of Patent: Mar. 6, 2007

(54) NICKEL POWDER AND PRODUCTION METHOD THEREFOR

(75) Inventors: Toshihiro Kato, Ehime (JP); Shuji Okada, Ehime (JP); Shoji Futaki, Ehime (JP)

(73) Assignee: Sunitomo Metal Mining Co., Ltd., Tokyo (JP)

( * ) Notice: Subject to any disclaimer, the term of this patent is extended or adjusted under 35 U.S.C. 154(b) by 0 days.

(21) Appl. No.: 10/970,849

(22) Filed: Oct. 19, 2004

(65) Prior Publication Data

US 2005/0072270 A1 Apr. 7, 2005

Related U.S. Application Data

(63) Continuation of application No. PCT/JP03/14754, filed on Nov. 19, 2003.

(30) Foreign Application Priority Data

Aug. 29, 2003 (JP) ..... 2003-305704

(51) Int. Cl.
*B22F 1/00* (2006.01)
*C22B 5/00* (2006.01)
*H01B 1/22* (2006.01)

(52) U.S. Cl. ..... 75/255; 75/246; 75/351; 75/374; 252/513

(58) Field of Classification Search ..... 75/255, 75/246, 351, 374; 428/570; 252/513
See application file for complete search history.

(56) References Cited

U.S. PATENT DOCUMENTS 3,920,410 A * 11/1975 Kunda et al. ..... 428/570
6,019,813 A 2/2000 Görge et al.
6,162,277 A * 12/2000 Toshima et al. ..... 75/255
2005/0262966 A1* 12/2005 Chandler et al. ..... 75/331

FOREIGN PATENT DOCUMENTS

| | | |
|---|---|---|
| EP | 1 127 638 | 8/2001 |
| EP | 1 151 814 | 11/2001 |
| JP | 8-246001 | 9/1996 |
| JP | 11-505884 | 5/1999 |
| JP | 2001-200301 | 7/2001 |
| JP | 2001-316701 | 11/2001 |
| JP | 2003-155506 | 5/2003 |
| WO | WO 96/37325 | 11/1996 |

* cited by examiner

*Primary Examiner*—Ngoclan T. Mai
(74) *Attorney, Agent, or Firm*—Katten Muchin Rosenman LLP

(57) ABSTRACT

There is provided a nickel powder suitable as conductive particles for use in conductive paste and conductive resin, that is inexpensive, has superior weather resistance, low resistivity when kneaded with resin, and is stable when used in the long-term, and a production method therefor.

A nickel powder is produced by a two stage reduction and precipitation process from an aqueous solution containing a bivalent nickel salt, wherein an average primary particle diameter is 0.2 μm to 2.0 μm as measured with a scanning electron microscope (SEM), wherein an average secondary particle diameter is 8 μm to 50 μm according to laser particle size distribution measurement, wherein a tap density is 0.5 g/ml to 2.0 g/ml, wherein a cobalt content is 1 to 20 weight %. The cobalt may be contained in only the surface layer of the nickel powder at a content of 1 weight % to 40 weight %.

20 Claims, 1 Drawing Sheet

NICKEL POWDER AND PRODUCTION METHOD THEREFOR

CROSS-REFERENCE TO RELATED APPLICATION

The present application is a continuation of International Application No. PCT/JP03/14754 which was filed on Nov. 19, 2003, which is herein incorporated by reference.

TECHNICAL FIELD

The present invention relates to nickel particles suitable as conductive particles for use in conductive paste and conductive resin, and a production method therefor.

BACKGROUND ART

Sn—Pb solder has conventionally been used in joints in electronic equipment. However in recent years the use of conductive paste is under consideration in response to demands for lead-free solder. Furthermore, devices employing conductive resin have become widely used in recent years.

The conductive pastes and conductive resins used in these applications are pastes, wherein conductive particles and various types of resins are kneaded together, and compacts formed by hardening the pastes. The properties required of conductive particles are high electrical conductivity of the particles themselves, low resistivity of the compact obtained by kneading the conductive particles with the resin, high resistance to migration, and superior weather resistance, and the like. Metal powder and carbon powder are currently employed as conductive particles.

However, of the metal powders, the precious metals have high electrical conductivity and low resistivity, but are expensive. Moreover, base metals as represented by nickel and copper and the like are inexpensive and have high electrical conductivity. However they have inferior weather resistance, and when used kneaded with resins to obtain conductive pastes and conductive resins, suffer from increased resistivity with long-term use. On the other hand, carbon powder is inexpensive and has high weather resistance. However it has low electrical conductivity, and high resistivity when kneaded with resin.

A powder wherein the surface of nickel particles or copper particles is coated with a precious metal such as Ag and the like has been proposed (Japanese Patent Unexamined Publication No. 2002-025345, and Japanese Patent Unexamined Publication No. 2002-075057) as a method of resolving these problems. The precious metal coating on the nickel particles or copper particles of these powders provides improvements in terms of properties, however they are expensive in cost. In particular, silver-coated powder is unsuitable for use in environments where resistance to migration is required.

Furthermore, attempts have been made to alter the surface shape of the nickel particles and the like, for example, by formation of small hemispherical protrusions on the surface, in order to decrease resistivity when kneaded with resin (Japanese Patent Unexamined Publication No. 2001-043734 and U.S. Pat. No. 5,378,407 specification). However, as the inferior weather resistance has not been improved, stability in long-term use cannot be considered to have improved. Based on this situation, provision of conductive particles that are inexpensive, have superior weather resistance, low resistivity when kneaded with resin, and stability when used in the long-term, is desired.

DISCLOSURE OF THE INVENTION

The present invention is in consideration of the aforementioned conventional situation, and provides a nickel powder suitable as conductive particles for use in conductive paste and conductive resin that is inexpensive, has superior weather resistance, low resistivity when kneaded with resin, and is stable when used in the long-term, and a production method therefor.

Research conducted by the inventors of the present invention in relation to the resistivity of compacts obtained by kneading nickel powder with resin have shown that the diameter and the tap density of the nickel powder particles have the greatest effect on the resistivity of the compact, and that control of these to within a specific range results in a significant decrease in resistivity of the compact.

Moreover, addition of cobalt to the nickel powder has the effect of improving the weather resistance of the nickel powder. In particular, it has been found that improvements in weather resistance are obtained even when cobalt is added to only the surface layer of the nickel powder, that is, the primary particles in the surface layer of the secondary particles.

That is to say, the nickel powder provided by the present invention is characterized in that an average primary particle diameter is 0.2 μm to 2.0 μm as measured with a scanning electron microscope, an average secondary particle diameter is 8 μm to 50 μm according to laser particle size distribution measurement, a tap density is 0.5 g/ml to 2.0 g/ml, and a cobalt content is 1 to 20 weight %.

It is desirable that the nickel powder of the present invention have a ratio of average secondary particle diameter according to laser particle size distribution measurement, and average primary particle diameter as measured with a scanning electron microscope, in other words, average secondary particle diameter/average primary particle diameter, within a range of 5 to 100. Here "average" is taken to mean, for an average secondary particle diameter (D50), the particle diameter wherein the cumulative volume according to laser particle size distribution measurement is 50%. The average primary particle diameter is found by measuring the diameter of 100 particles on a ×5000 photograph taken with a scanning electron microscope (SEM), and computing the average. Furthermore, in the nickel powder of the present invention, it is desirable that cobalt is only contained in the surface layer, that is, in the primary particles in the surface layer of the secondary particles, and that the cobalt content of the surface layer is 1 weight % to 40 weight %. While the upper limit for cobalt content when included throughout the particles is 20 weight %, the upper limit for cobalt content when included only in the surface layer is 40 weight %. This is due to the fact that the cobalt content when included only in the surface layer may be decreased in comparison with the case wherein it is included throughout the particles, with consequent cost benefits.

Moreover, the method of producing the nickel powder provided by the present invention comprises; a first stage reduction and precipitation process wherein a reducing agent is added to an aqueous solution containing a bivalent nickel salt to precipitate nickel, and a second stage reduction and precipitation process wherein at least a bivalent nickel salt solution is added to the aqueous solution to precipitate further nickel, and is characterized in that in at least the second of the first and second stage reduction and precipitation processes, nickel is precipitated in a state wherein a bivalent cobalt salt has been added to the aqueous solution.

In the method of producing the nickel powder of the present invention, it is desirable to add a bivalent cobalt salt to the aqueous solution in the second stage reduction and precipitation process to provide cobalt at a proportion of 1 weight % to 40 weight % of the total of nickel and cobalt, and thus obtain nickel powder containing cobalt only in the surface layer. Furthermore, in the method of producing the nickel powder of the present invention, a bivalent cobalt salt can be added to each aqueous solution in the first stage and second stage reduction and precipitation processes to obtain a proportion of cobalt of 1 weight % to 20 weight % of the total of nickel and cobalt, and thus obtain nickel powder containing cobalt throughout the particles.

The nickel powder obtained with the present invention is inexpensive, and the compact of kneaded nickel powder and resin has remarkably low resistivity and superior weather resistance, and can be used in a stable manner in the long-term. This nickel powder is particularly suitable as conductive particles for use in conductive paste and conductive resin.

BEST MODE FOR CARRYING OUT THE INVENTION

Figure 1:
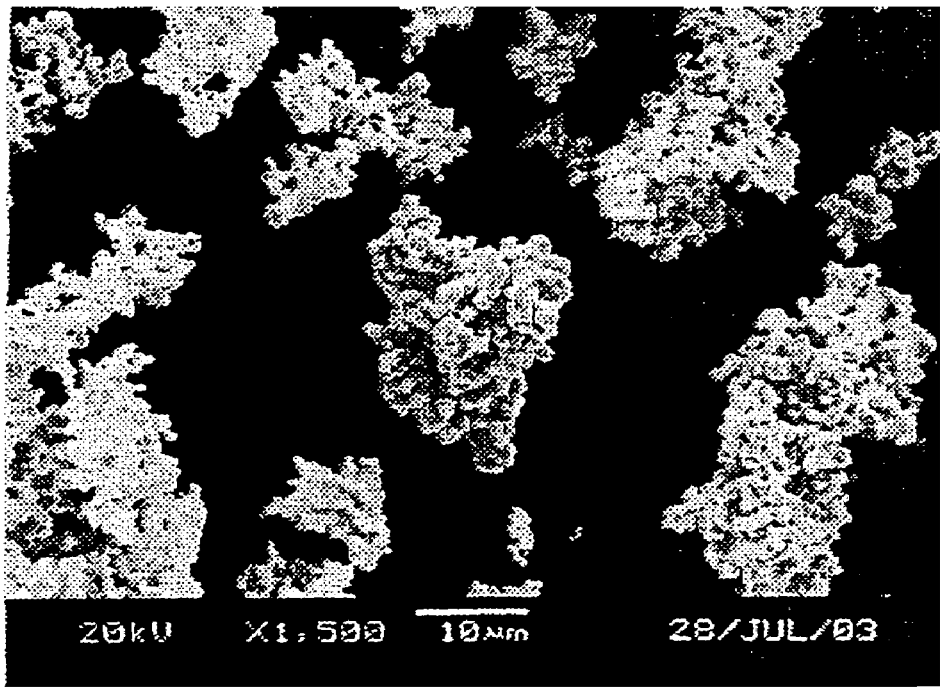
FIG. 1 is a SEM photograph (×1500) of the nickel powder of the present invention.
Figure 2:
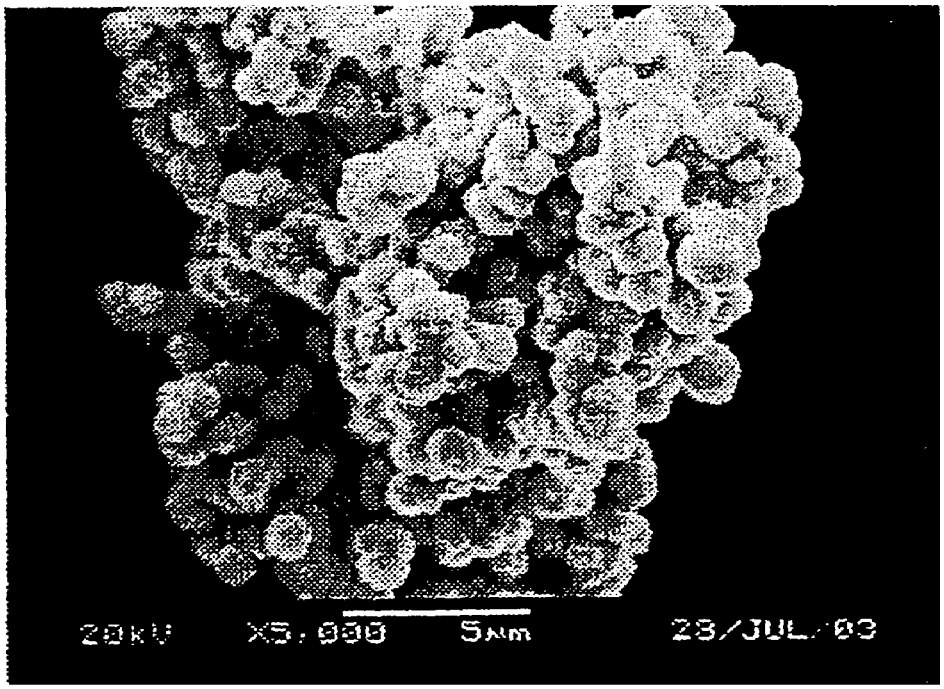
FIG. 2 is a SEM photograph (×5000) of the nickel powder of the present invention.

As shown in FIG. 1 and FIG. 2, the nickel powder of the present invention comprises secondary particles in the form of strongly agglomerated primary particles. This nickel powder of the present invention has an average primary particle diameter of 0.2 μm to 2.0 μm as measured with a scanning electron microscope (SEM), an average secondary particle diameter (D50) of 8 μm to 50 μm according to laser particle size distribution measurement, and a tap density of 0.5 g/ml to 2.0 g/ml. Here, "D50" is taken to mean, for an average secondary particle diameter (D50), the particle diameter wherein the cumulative volume according to laser particle size distribution measurement is 50%. Moreover, the average primary particle diameter is found by measuring the diameter of 100 particles on a ×5000 photograph taken with a scanning electron microscope (SEM), and computing the average.

Primary particle diameter as measured from SEM observations indicates the individual diameter of agglomerated primary particles. Average primary particle diameter as measured from SEM observations is controlled to a range of 0.2 μm to 2.0 μm, so that the primary particles is appropriately agglomerated to form secondary particles of complex shapes such as chains and the like. As a result, the compact formed by kneading with resin comprises a network of intertwined secondary particles, and therefore has a dramatically decreased resistivity. However, a decrease in average primary particle diameter to less than 0.2 μm is undesirable since agglomeration of the primary particles becomes excessively intense, and the secondary particles after agglomeration resemble large lumps or balls. Furthermore, when the average primary particle diameter exceeds 2.0 μm, agglomeration of the primary particles is insufficient in amount and a state is reached close to that wherein the primary particles are dispersed.

Secondary particle diameter according to laser particle distribution measurement indicates the diameter of secondary particles being agglomerates of primary particles. Control of average secondary particle diameter (D50) according to laser particle distribution measurement to a range of 8 μm to 50 μm increases the number of locations wherein nickel particles come into contact with each other following kneading with resin, and dramatically decreases resistivity. However, a decrease in average secondary particle diameter (D50) to less than 8 μm decreases agglomeration of the primary particles, thus decreasing the number of locations wherein secondary particles intertwine, and increasing the resistivity of the compact of kneaded nickel powder and resin. Moreover, an increase in average secondary particle diameter (D50) to beyond 50 μm is undesirable since dispersion of the nickel powder in the resin becomes non-uniform.

Furthermore, the tap density of the nickel powder affects the degree of dispersion within the resin. Control of tap density to a range of 0.5 g/ml to 2.0 g/ml results in uniform dispersion of the nickel powder throughout the resin, dramatically decreasing the resistivity of the compact thus obtained. However, if tap density exceeds 2.0 g/ml, the distribution of the nickel powder in the resin becomes non-uniform and mutual contact is decreased. On the other hand, if tap density is less than 0.5 g/ml, it becomes difficult to knead the nickel powder with the resin, and thus a compact cannot be obtained.

Addition of a small amount of cobalt to the nickel powder of the present invention dramatically improves weather resistance. While the reasons are unclear, it is thought that since cobalt (Co) is slightly more basic than nickel (Ni), it is more readily corroded, resulting in an improvement in the weather resistance of nickel. However, at a cobalt content of less than 1 weight % with respect to the whole nickel powder, there is no improvement in weather resistance, and in excess of 20 weight % cost becomes prohibitive, which is thus undesirable.

It is desirable to provide a cobalt content only in the surface layer of the nickel powder in order to obtain sufficient weather resistance while minimizing cobalt content. In this case, the surface layer of the nickel powder is the portion formed in the second stage reduction and precipitation process in the production method explained hereunder, and comprises the primary particles on the surface of secondary particles formed by agglomeration of primary particles. It is desirable to control the cobalt content of the primary particles on the surface to a range of 1 weight % to 40 weight %. A cobalt content of the primary particles in the surface layer of 1 weight % or more is required to obtain the necessary weather resistance. However it is difficult to obtain further improvement in weather resistance at a cobalt content in excess of 40 weight %, and/or the nickel powder containing such a cobalt content exhibits ferromagnetism, and thus is undesirable in use in electronic components and the like.

Moreover, for the nickel powder of the present invention, it is desirable that the ratio of average secondary particle diameter (D50) according to laser particle size distribution measurement to average primary particle diameter measured from SEM observations, that is, the ratio of average secondary particle diameter (D50)/average primary particle diameter (SEM diameter), is within a range of 5 to 100. When this ratio of average secondary particle diameter (D50)/average primary particle diameter (SEM diameter) is within a range of 5 to 100, contact occurs readily between nickel particles when kneaded with resin, and a low resistivity is obtained. However, when this ratio is less than 5, contact between the nickel particles becomes difficult, and at a ratio in excess of 100, agglomerates become too large so that dispersion of the nickel powder in the resin becomes non-uniform. Both are therefore undesirable.

The following explains the method of producing the nickel powder of the present invention. The nickel powder of the present invention is produced from an aqueous solution containing a bivalent nickel salt in two stages of reduction and precipitation. That is to say, in the first stage reduction and precipitation process, a reducing agent is added (generally added to excess) to an aqueous solution containing a bivalent nickel salt to precipitate almost all the nickel. In the succeeding second stage reduction and precipitation process, a solution of a bivalent nickel salt is added to the aqueous solution containing the nickel powder precipitated in the first stage reduction and precipitation process, and a reducing agent is added as required to precipitate further nickel. At this time, polyvalent carboxylic acids such as tartaric acid and the like, complexing agents normally used such as ethylenediamine and the like, and sodium hydroxide and the like to adjust pH, can be added to the aqueous solution containing the bivalent nickel salt. Any reducing agent able to reduce and precipitate nickel may be used, however hydrazine-type reducing agents are ideal.

In the aforementioned production process, the nickel particles precipitated in the first stage reduction and precipitation process form secondary particles by appropriate agglomeration of the primary particles. However the cohesive forces of these secondary particles are weak and they are readily separated into individual particles, during separation from reactant solutions and kneading with resin. In practice, precipitation of further nickel in the second stage reduction and precipitation process strengthens the agglomeration of the secondary particles, so that the appropriate state of agglomeration can be maintained without separation during subsequent operations, and the resistivity of the compact formed by kneading of the nickel powder thus obtained with resin is dramatically decreased. It is considered that the nickel primary particles precipitated in the second stage reduction and precipitation process are agglomerated on the outside of the secondary particles precipitated and agglomerated in the first stage reduction and precipitation process, and are joined in a network structure to form a strong nickel powder.

By adjusting the concentration of the nickel salt and reducing agent, the temperature of the aqueous solution, and other conditions, the properties of the nickel powder produced in the second stage reduction and precipitation process, in other words properties of, an average primary particle diameter of between 0.2 μm and 2.0 μm as measured with a scanning electron microscope, an average secondary particle diameter of between 8 μm and 50 μm according to laser particle distribution measurement, and a tap density of between 0.5 g/ml and 2.0 g/ml, can be controlled.

Cobalt is included in the nickel powder by precipitating nickel from the aqueous solution wherein a bivalent cobalt salt has been added, in either the second stage reduction and precipitation process alone, or in both the first stage and second stage reduction and precipitation processes. In particular, when cobalt is included only in the surface layer and not in the interior of the nickel powder, cobalt is not added in the first stage reduction and precipitation process, and a bivalent cobalt salt is added to the aqueous solution in the second stage reduction and precipitation process. In this case, the amount of cobalt salt added is 1 weight % to 40 weight % of the total of nickel and cobalt in the aqueous solution, and thus the cobalt content of the surface layer of the nickel powder can be controlled to 1 weight % to 40 weight %.

Furthermore, when cobalt is included in both the surface layer and the interior of the nickel powder, the bivalent cobalt salt is added to the aqueous solution in each of the first stage and second stage reduction and precipitation processes. In this case, the amount of cobalt salt added is 1 weight % to 20 weight % of the total of nickel and cobalt in the aqueous solution in each of the first stage and second stage reduction and precipitation processes, or may be adjusted such that the final cobalt content of the whole nickel powder is 1 weight % to 20 weight %.

FIRST EXAMPLE

Sodium hydroxide and tartaric acid were added to 750 ml of pure water and heated to 85° C. while stirring. Sixty ml of hydrazine, and an aqueous solution of nickel chloride being 13 g of nickel, were added to this aqueous solution, and nickel precipitated with the first stage reduction reaction. An aqueous solution comprised of an aqueous solution of cobalt chloride and an aqueous solution of nickel chloride mixed such that cobalt content was 10 weight % of the total of nickel and cobalt, was then added to the aqueous solution following completion of the first stage reduction reaction, in an amount being 13 g of nickel and cobalt, and further nickel precipitated with the second stage reduction reaction. The precipitate was then filtered and washed, and air dried at 80° C. to obtain a nickel powder sample 1.

The obtained nickel powder sample 1 contained cobalt only in the surface layer. Properties of the powder are shown hereunder in Table 1. The overall cobalt content is the value obtained from analysis, however the cobalt content of the surface layer is a value computed from the amount of cobalt in the aqueous solution of nickel and cobalt in the second stage reduction and precipitation process. Moreover, in Table 1, "SEM diameter" is the average primary particle diameter as measured from SEM observations, and "D50" is the average secondary particle diameter according to laser particle size distribution measurement.

A compact was formed by kneading 2.4 g of the nickel powder of sample 1 with 3 g of thermosetting resin (phenolic resin), forming the product into a sheet, and hardening. This was cut to 12 mm in width, and resistivity then measured between electrodes at 5 mm spacing. The initial resistance value was 4.5. Furthermore, in order to evaluate weather resistance, the same sample 1 of nickel powder was heated for 40 hours in an air-conditioned tank set to 85° C. and 85% relative humidity, then kneaded with thermosetting resin (phenolic resin), and the resistivity of the compact thus obtained measured. The resistance value following moisture resistance testing was 36.5. These results, and the rate of increase in resistance values following moisture resistance testing, are shown hereunder in Table 2.

SECOND EXAMPLE

Two-stage reduction and precipitation of nickel was conducted with the same method as the first example. Here, an aqueous solution comprised of an aqueous solution of cobalt chloride and an aqueous solution of nickel chloride mixed such that cobalt content was 10 weight % of the total of nickel and cobalt was used. This aqueous solution was added in an amount being 13 g of nickel and cobalt in each of the first stage and second stage reduction and precipitation processes to obtain a nickel powder sample 2.

The obtained nickel powder sample 2 contained cobalt throughout the nickel powder (interior and surface layer). Properties of the powder are shown hereunder in Table 1. Moreover, measurement of the resistivity value of the compact obtained from the nickel powder sample 2 in the same manner as with the first example, showed an initial resistance value of 5.1, and a resistance value following moisture resistance testing of 40.3. These results are summarized hereunder in Table 2.

THIRD EXAMPLE

Two-stage reduction and precipitation of nickel was conducted in the same manner as the first example. Here, an amount of aqueous solution of nickel chloride being 6 g of nickel was added during the first stage reduction and precipitation, and only during the second stage reduction and precipitation, an aqueous solution comprised of an aqueous solution of cobalt chloride and an aqueous solution of nickel chloride mixed such that cobalt content was 3.5 weight % of the total of nickel and cobalt was added in an amount being 20 g of nickel and cobalt, to obtain a nickel powder sample 3.

The obtained nickel powder sample 3 contained cobalt only in the surface layer. Properties of the nickel powder are shown hereunder in Table 1. Furthermore, measurement of the resistivity value of the compact obtained from the nickel powder sample 3 in the same manner as with the first example, showed an initial resistance value of 7.6, and a resistance value following moisture resistance testing of 75.7. These results are summarized hereunder in Table 2.

FOURTH EXAMPLE

Two-stage reduction and precipitation of nickel was conducted in the same manner as the first example. Here, an amount of aqueous solution of nickel chloride being 13 g of nickel was added during the first stage reduction and precipitation, and only during the second stage reduction and precipitation, an aqueous solution comprised of an aqueous solution of cobalt chloride and an aqueous solution of nickel chloride mixed such that cobalt content was 30 weight % of the total of nickel and cobalt was added in an amount being 13 g of nickel and cobalt, to obtain a nickel powder sample 4.

The obtained nickel powder sample 4 contained cobalt only in the surface layer. Properties of the nickel powder are shown hereunder in Table 1. Furthermore, measurement of the resistivity value of the compact obtained from the nickel powder sample 4 in the same manner as with the first example, showed an initial resistance value of 4.8, and a resistance value following moisture resistance testing of 23.5. These results are summarized hereunder in Table 2.

FIFTH EXAMPLE

Two-stage reduction and precipitation of nickel was conducted in the same manner as the second example. Here, an aqueous solution comprised of an aqueous solution of cobalt chloride and an aqueous solution of nickel chloride mixed such that cobalt content was 1.0 weight % of the total of nickel and cobalt was used. This aqueous solution was added in an amount being 13 g of nickel and cobalt in each of the first stage and second stage reduction and precipitation processes to obtain a nickel powder sample 5.

The obtained nickel powder sample 5 contained cobalt throughout the nickel powder (interior and surface layer). Here the powder properties of the nickel powder are shown hereunder in Table 1. Moreover, measurement of the resistivity value of the compact obtained from the nickel powder sample 5 in the same manner as with the first example, showed an initial resistance value of 5.3, and a resistance value following moisture resistance testing of 70.0. These results are summarized hereunder in Table 2.

SIXTH EXAMPLE

Two-stage reduction and precipitation of nickel was conducted in the same manner as the first example. An amount of aqueous solution of nickel chloride being 13 g of nickel was added during the first stage reduction and precipitation, and only during the second stage reduction and precipitation, an aqueous solution comprised of an aqueous solution of cobalt chloride and an aqueous solution of nickel chloride mixed such that cobalt content was 40 weight % of the total of nickel and cobalt was added in an amount being 13 g of nickel and cobalt, to obtain a nickel powder sample 6.

The obtained nickel powder sample 6 contained cobalt only in the surface layer. Properties of the nickel powder are shown hereunder in Table 1. Furthermore, measurement of the resistivity value of the compact obtained from the nickel powder sample 6 in the same manner as with the first example, showed an initial resistance value of 6.2, and a resistance value following moisture resistance testing of 28.5. These results are summarized hereunder in Table 2.

COMPARATIVE EXAMPLE 1

Two-stage reduction and precipitation of nickel was conducted with the same method as the first example. Here, an aqueous solution of cobalt chloride was not added in both of the first stage and second stage reduction and precipitation processes, and the nickel powder sample 7 obtained. An amount of aqueous solution of nickel chloride being 13 g of nickel was added during the first stage reduction and precipitation, and an amount being 5 g of nickel was added during the second stage reduction and precipitation.

The obtained nickel powder sample 7 contained no cobalt. Properties of the nickel powder are shown hereunder in Table 1. Furthermore, measurement of the resistivity value of the compact obtained from the nickel powder sample 7 in the same manner as with the first example showed an initial resistance value of 5.2, and a resistance value following moisture resistance testing of 123.1. These results are summarized hereunder in Table 2.

Powder properties of a representative filler-type nickel powder marketed as conductive particles for use in conductive paste and conductive resin are shown hereunder in Table 1 as sample 7a. Furthermore, measurement of the resistivity value of the compact obtained from the nickel powder of sample 7a in the same manner as with the first example showed an initial resistance value of 5.2, and a resistance value following moisture resistance testing of 102.5. These results are included hereunder in Table 2 for reference purposes.

COMPARATIVE EXAMPLE 2

Sodium hydroxide and tartaric acid were added to 750 ml of pure water and heated to 85° C. while stirring. Sixty ml of hydrazine, and an aqueous solution of nickel chloride being 26 g of nickel, were added to this aqueous solution, and nickel precipitated in only one stage of reduction and precipitation. The precipitate was then filtered and washed, and air dried at 80° C. to obtain a nickel powder sample 8. Moreover, apart from the use of ethylenediamine in place of the complexing agent tartaric acid, a nickel powder sample 9 was obtained in the same manner as above.

The obtained nickel powder samples 8 and 9 contained no cobalt. Powder properties of the nickel powders are shown hereunder in Table 1. Furthermore, measurement of the resistivity value of the compacts obtained from the nickel powder samples 8 and 9 in the same manner as with the first example showed extremely high initial resistance values in excess of $10^6$, and resistance values following moisture resistance testing were therefore not measured. These results are summarized hereunder in Table 2.

COMPARATIVE EXAMPLE 3

A nickel powder was precipitated by a reduction and precipitation process in only one stage, with the same method as in comparative example 2, using tartaric acid as a complexing agent. In this case, the stirring conditions were altered to ensure a slow stirring speed, and a nickel powder sample 10 obtained.

The obtained nickel powder sample 10 contained no cobalt. Powder properties of the nickel powder are shown in hereunder Table 1. Moreover, measurement of the resistivity value of the compact obtained from the nickel powder sample 10 in the same manner as with the first example showed a high initial resistance value of 1050, and resistance values following moisture resistance testing were therefore not measured. These results are summarized hereunder in Table 2.

COMPARATIVE EXAMPLE 4

Nickel hydroxide powder was reduced in a mixed atmosphere of hydrogen and nitrogen at 450° C., and a nickel powder sample 11 obtained. The nickel powder sample 11 obtained with this dry method did not contain cobalt. Properties of the powder are shown hereunder in Table 1. Furthermore, measurement of the resistivity value of the nickel powder sample 11 obtained in the same manner as with the first example showed a high initial resistance value of 1713, and the resistance value following moisture resistance testing was therefore not measured. These results are summarized hereunder in Table 2.

TABLE 1

| Sample | Co content (wt. %) whole body surface | SEM-d (.m) | SEM-d (.m) | D50 / SEM-d | D50/ (g/ml) | Tap density portion |
|---|---|---|---|---|---|---|
| 1 | 4.3 | 10 | 1.1 | 20.9 | 19.0 | 0.98 |
| 2 | 9.8 | 10 | 0.6 | 45.2 | 75.3 | 1.26 |
| 3 | 2.5 | 3.5 | 0.8 | 9.5 | 11.9 | 1.75 |
| 4 | 14.3 | 30 | 0.7 | 18.2 | 26.0 | 1.31 |
| 5 | 1.2 | 1.0 | 0.6 | 16.5 | 27.5 | 0.75 |
| 6 | 19.8 | 40 | 0.9 | 35.1 | 39.0 | 1.66 |
| 7* | .0.01 | — | 0.4 | 13.4 | 33.5 | 0.71 |
| 7a* | .0.01 | — | 1.8 | 16.5 | 9.2 | 1.47 |
| 8* | .0.01 | — | 0.6 | 2.2 | 3.7 | 1.60 |
| 9* | .0.01 | — | 0.7 | 1.5 | 2.1 | 0.58 |
| 10* | .0.01 | — | 0.5 | 6.5 | 13.0 | 2.40 |
| 11* | .0.01 | — | 7.5 | 10.3 | 1.4 | 2.27 |

(SEM-d = SEM diameter)
(*= Comparative Example)

TABLE 2

| Sample | resistance when kneaded with resin (.) initial | after moisture resistance testing | Increase rate of resistance (times) |
|---|---|---|---|
| 1 | 4.5 | 36.5 | 8.1 |
| 2 | 5.1 | 40.3 | 7.9 |
| 3 | 7.6 | 75.7 | 9.9 |
| 4 | 4.8 | 23.5 | 4.9 |
| 5 | 5.3 | 70.0 | 13.2 |
| 6 | 6.2 | 28.5 | 4.6 |
| 7* | 5.2 | 123.1 | 23.7 |
| 7a* | 5.2 | 102.5 | 19.7 |
| 8* | $.10^6$ | — | — |
| 9* | $.10^6$ | — | — |
| 10* | 1050 | — | — |
| 11* | 1713 | — | — |

(*= Comparative Example)

The invention claimed is:

1. A nickel powder containing 1 weight % to 20 weight % of cobalt with the remainder of nickel and unavoidable impurities, and formed from secondary particles comprising agglomerated primary particles, characterized in that an average primary particle diameter is 0.2 μm to 2.0 μm as measured with a scanning electron microscope, an average secondary particle diameter is 8 μm to 50 μm according to laser particle size distribution measurement, and a tap density is 0.5 g/ml to 2.0 g/ml.

2. A nickel powder according to claim 1, wherein a ratio of average secondary particle diameter according to laser particle size distribution measurement, and average primary particle diameter as measured with a scanning electron microscope (average secondary particle diameter/average primary particle diameter) is within a range of 5 to 100.

3. A nickel powder according to claim 1, wherein cobalt is only contained in the surface layer, wherein said surface layer comprises the primary particles on the surface of secondary particles, and the cobalt content of said surface layer is 1 weight % to 40 weight %.

4. A method of producing nickel powder comprising the steps of:

a first stage reduction and precipitation step wherein a reducing agent is added to an aqueous solution containing a bivalent nickel salt to precipitate nickel; and a second stage reduction and precipitation step wherein at least a bivalent nickel salt solution is added to said aqueous solution to further precipitate nickel, and characterized in that in at least the second of said first and second stage reduction and precipitation steps, nickel is precipitated in a state wherein a bivalent cobalt salt has been added to the aqueous solution.

5. A method of producing nickel powder according to claim 4, wherein an amount of bivalent cobalt salt added to the aqueous solution in said second stage reduction and precipitation step is such as to provide cobalt at a proportion of 1 weight % to 40 weight % of the total of nickel and cobalt, to thus obtain nickel powder containing cobalt only in the surface layer of the secondary particles.

6. A method of producing nickel powder according to claim 4, wherein an amount of bivalent cobalt salt added to the aqueous solution in said second stage reduction and precipitation step is such as to provide cobalt at a proportion of 1 weight % to 20 weight % of the total of nickel and cobalt, to thus obtain nickel powder containing cobalt throughout the secondary particles.

7. A method of producing nickel powder according to claim 4, wherein bivalent cobalt salt is added to the aqueous solution in said first stage reduction and precipitation step such as to provide cobalt at a proportion of 1 weight % to 20 weight % of the total of nickel and cobalt, so that cobalt is contained throughout the secondary particles.

8. A nickel powder produced according to a method comprising the steps of:

a first stage reduction and precipitation step wherein a reducing agent is added to an aqueous solution containing a bivalent nickel salt to precipitate nickel; and a second stage reduction and precipitation step wherein at least a bivalent nickel salt solution is added to said aqueous solution to further precipitate nickel, and characterized in that in at least the second of said first and second stage reduction and precipitation steps, nickel is precipitated in a state wherein a bivalent cobalt salt has been added to the aqueous solution, wherein the cobalt content of the whole nickel powder is 1 weight % to 20 weight %, and characterized in that an average primary particle diameter is 0.2 μm to 2.0 μm as measured with a scanning electron microscope, an average secondary particle diameter is 8 μm to 50 μm according to laser particle size distribution measurement, and a tap density is 0.5 g/ml to 2.0 g/ml.

9. A nickel powder according to claim 8, wherein an amount of bivalent cobalt salt added to the aqueous solution only in said second stage reduction and precipitation step is such as to provide cobalt at a proportion of 1 weight % to 40 weight % of the total of nickel and cobalt, thus the nickel powder contains cobalt in the surface layer thereof and the cobalt content of the surface layer is 1 weight % to 40 weight %.

10. A conductive paste comprising a resin and the nickel powder of claim 1.

11. The conductive paste of claim 10 where the nickel powder is a nickel power according to claim 2.

12. The conductive paste of claim 10 where the nickel powder is a nickel power according to claim 3.

13. The conductive paste of claim 10 where the resin is a thermosetting resin.

14. The conductive paste of claim 10 where the resin is a phenolic resin.

15. The conductive paste of claim 10 wherein the paste is formed by kneading together the nickel powder and resin.

16. The conductive paste of claim 11 wherein the paste is formed by kneading together the nickel powder and resin.

17. The conductive paste of claim 12 wherein the paste is formed by kneading together the nickel powder and resin.

18. A conductive resinous object comprising a thermosetting resin and the nickel powder according to claim 1 prepared by kneaded together the nickel powder and resin, shaping the kneaded combination into the form of object and hardening the object.

19. A conductive resinous object comprising a thermosetting resin and the nickel powder according to claim 2 prepared by kneaded together the nickel powder and resin, shaping the kneaded combination into the form of object and hardening the object.

20. A conductive resinous object comprising a thermosetting resin and the nickel powder according to claim 3 prepared by kneaded together the nickel powder and resin, shaping the kneaded combination into the form of object and hardening the object.

* * * * *